United States Patent [19]

Barrington

[11] Patent Number: 4,669,539

[45] Date of Patent: Jun. 2, 1987

[54] LOCK FOR DOWNHOLE APPARATUS

[75] Inventor: Burchus Q. Barrington, Duncan, Okla.

[73] Assignee: Halliburton Company, Duncan, Okla.

[21] Appl. No.: 876,955

[22] Filed: Jun. 18, 1986

[51] Int. Cl.[4] ..... E21B 23/04; E21B 33/124

[52] U.S. Cl. ..... 166/120; 166/212; 166/191

[58] Field of Search ..... 166/212, 120, 191, 86, 166/88, 206, 207

[56] References Cited

U.S. PATENT DOCUMENTS

| | | | |
|---|---|---|---|
| Re. 29,471 | 11/1977 | Giroux | 166/334 |
| 2,698,058 | 12/1954 | Page | 166/212 |
| 2,760,580 | 8/1956 | Johnston | 166/120 |
| 2,880,805 | 4/1959 | Nelson et al. | 166/212 X |
| 2,915,011 | 12/1959 | Hamill | 166/212 X |
| 2,979,134 | 4/1961 | Reed et al. | 166/187 |
| 3,165,919 | 1/1965 | Loomis | 73/40.5 |
| 3,173,290 | 3/1965 | Conover | 73/40.5 |
| 3,233,675 | 2/1966 | Tamplen et al. | 166/120 |
| 3,448,805 | 6/1969 | Brown | 166/212 |
| 3,664,415 | 5/1972 | Wray et al. | 166/336 |
| 3,850,250 | 11/1974 | Holden et al. | 166/374 |
| 3,970,147 | 7/1976 | Jessup et al. | 166/250 |
| 4,056,145 | 11/1977 | Jett et al. | 166/212 |
| 4,063,593 | 12/1977 | Jessup | 166/317 |
| 4,064,937 | 12/1977 | Barrington | 166/162 |
| 4,109,724 | 8/1978 | Barrington | 166/374 |
| 4,133,386 | 1/1979 | Knox | 166/212 X |
| 4,230,180 | 10/1980 | Patton et al. | 166/185 |
| 4,258,787 | 3/1981 | Amancharla | 166/212 X |
| 4,270,610 | 6/1981 | Barrington | 166/317 |
| 4,281,715 | 8/1981 | Farley | 166/317 |
| 4,319,633 | 3/1982 | McMahan et al. | 166/250 |
| 4,386,656 | 6/1983 | Fisher et al. | 166/212 X |

FOREIGN PATENT DOCUMENTS 2157003 10/1985 United Kingdom .

*Primary Examiner*—Stephen J. Novosad

*Attorney, Agent, or Firm*—Joseph A. Walkowski; E. Harrison Gilbert, III

[57] ABSTRACT

A lock, particularly suitable for locking a top packer against upward movement relative to a lower packer in a well bore, includes a radially movable latch member slidably mounted in a radial cavity defined in an inner mandrel which is movable relative to an outer member to which the top packer is connected in the exemplary use. Spring biasing elements are used to retain the latch member in a disengaged position until, from within the mandrel, an actuating pressure is exerted radially outwardly on the latch member with a force greater than the biasing force of the spring biasing elements and a radially inwardly acting force exerted by a hydrostatic pressure existing externally of the outer member but communicated internally thereof. When this occurs, gripping teeth on the latch member interlock with an engagement surface on the interior of the outer member.

19 Claims, 9 Drawing Figures

LOCK FOR DOWNHOLE APPARATUS

BACKGROUND OF THE INVENTION

This invention relates generally to a lock for a downhole apparatus and more particularly, but not by way of limitation, to a hydraulic lock for holding down an upper packer mounted on a packer mandrel connected to a lower packer disposed in an open well bore.

In fracturing a formation intersected by a well bore, it is known that two seals, referred to as packers, are set in the well at the upper and lower boundaries of the formation to be fractured. A pressurized fracturing fluid is then injected between the set packers through a tubing or pipe string on which the packers are carried into the hole. Such procedure can be used either when the well bore is lined with a casing or when the well bore is unlined (referred to herein as an open well bore, or the like). It is important that once the packers are set, they remain set (until specifically released) so that the fracturing fluid will be properly contained to achieve the desired fracturing and so that hazardous conditions are not thereby created. It is also important for the packers to remain set when a measuring tool, such as a precision caliper tool subassembly, is carried between them. Any movement of the packers that is communicated to a tool such as a caliper could produce false readings and seriously damage such a tool when it has its measurement arms extended.

When the well bore is lined with a casing or the like, known types of mechanical and hydraulic slips can be used to engage the casing so that upward movement of the top packer, such as in response to the pressure of the fracturing fluid exceeding the hydrostatic pressure existing above the top packer, is prevented. Preventing such upward movement can also sometimes be accomplished to some degree by "slacking off" the tubing or pipe string so that the weight of the string exerts a downward acting force on the packers.

When packers are to be set in open well bores, however, the aforementioned mechanical and hydraulic slips have not been helpful in anchoring the top packer against upward movement. Likewise, the use of "slacked-off" tubing has been inadequate in general because in deep wells where the slacked-off pipe weight would be sufficient to prevent upward movement, the weight has been known to create a force exceeding the loading characteristic of the packer, thereby damaging it. In shallower wells, the upward applied force exerted by the fracturing fluid can easily overcome the lesser pipe weight, thereby causing the top packer to become unseated.

The foregoing problem particularly pertains to upward movement of the top packer because the lower packer has the greater fracturing fluid pressure acting downwardly on it, and its downward movement is limited by an anchor pipe resting on the bottom of the hole or engaging the side wall of the bore. The interconnecting construction of conventional dual packers known to the art is such that this downward limitation is also applicable to the top packer so that it is only the upward movement of the upper packer which is of primary concern.

Although one can circumvent this problem by always casing or lining the well bore and by then using the known types of casing engaging locks, it is desirable to solve the problem in a manner whereby open hole packers can be securely set and locked in open well bores because this saves the time and expense of always having to case or line the well bore while still accomplishing reliable fracturing.

The foregoing exemplifies the particular need for a lock by which a top or upper packer can be locked relative to a bottom or lower packer to prevent upward movement of the upper packer in response to the fracturing fluid pressure exerted between the two packers when the packers are used in an open well bore. The satisfaction of this need, however, would also provide an improved lock useful in other types of downhole apparatus which require locking against relative movement between different parts of the apparatus.

SUMMARY OF THE INVENTION

The present invention overcomes the above-noted and other shortcomings of the prior art and satisfies the aforementioned needs by providing a novel and improved lock for a downhole apparatus. The present invention has particular utility in a double packer used in an open well bore. That is, with the present invention the upper packer of the double or dual packer assembly can be controllably locked and unlocked against upward movement which would otherwise occur in response to a pressure, applied through the tubing between the two packers, exceeding the hydrostatic pressure and the weight of the pipe or tubing acting downwardly on the upper packer. It is contemplated that the present invention could, however, have broader applications with respect to, in general, a downhole apparatus having an inner tubular member and an outer tubular member in which the inner tubular member is slidably disposed.

Broadly, the lock of the present invention for such a general downhole tool comprises a latch member mounted on one of the inner and outer tubular members; actuating pressure communicating means, disposed in the one of the inner and outer tubular members on which the latch member is mounted, for communicating an actuating pressure to the latch member so that the latch member moves towards the other of the inner and outer tubular members in response to the actuating pressure; and latch member engagement means, mounted on the other of the inner and outer tubular members, for interlocking with the latch member when the latch member is moved in response to the actuating pressure.

In the preferred embodiment this lock further comprises biasing means, connected to the one of the inner and outer tubular members on which the latch member is mounted, for biasing the latch member away from the other of the inner and outer tubular members. This preferred embodiment lock also comprises hydrostatic pressure communicating means, disposed in the other of the inner and outer tubular members, for communicating a hydrostatic pressure to the latch member so that a force exerted by the hydrostatic pressure is applied to the latch member in opposition to a force exerted on the latch member by the actuating pressure.

In a particular embodiment where the present invention is a hydraulic lock for holding down an upper packer mounted on a packer mandrel connected to a lower packer, the lock comprises a locking sleeve connected to the upper packer. The locking sleeve has an inner surface along which is defined a locking sleeve engagement surface. This lock also comprises a locking mandrel which is connected to the packer mandrel and which has an outer surface facing the inner surface of the locking sleeve and which also has an inner surface defining an axial channel through the locking mandrel. The outer surface has a radial cavity defined therethrough extending within the locking mandrel towards the axial channel. This lock further comprises a latch member slidably disposed in the cavity. The latch member has a latch member engagement surface facing the inner surface of the locking sleeve. This lock still further comprises hydraulic pressure communicating means, disposed in the locking mandrel, for communicating a hydraulic pressure from the axial channel into the cavity and against the latch member, whereby the latch member is thereby movable, so that at least a portion of the latch member engagement surface interlocks with at least a portion of the locking sleeve engagement surface when the portions are radially aligned and the hydraulic pressure is applied.

Therefore, from the foregoing, it is a general object of the present invention to provide a novel and improved lock for a downhole apparatus and more particularly to provide a hydraulic lock for holding down an upper packer mounted on a packer mandrel connected to a lower packer. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
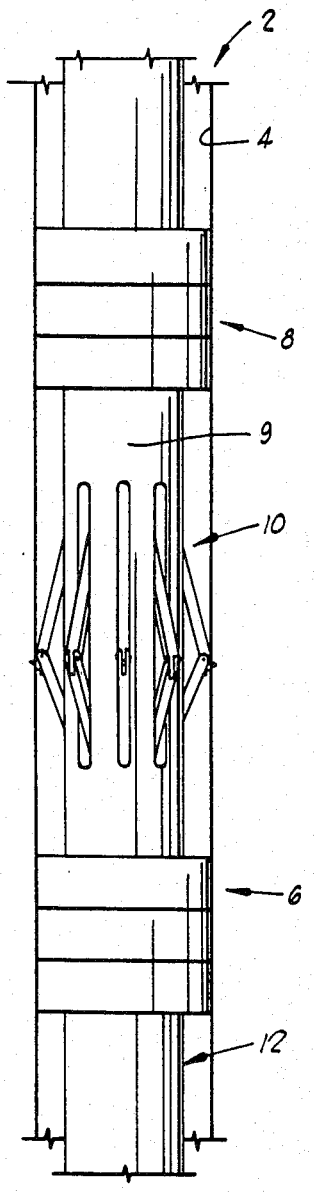
FIG. 1 is a schematic illustration of a double or dual packer/working tool assembly with which a lock of the present invention can be used.

The preferred embodiment of the present invention will be described with reference to a dual packer assembly 2 disposed in an open well bore 4. This particular construction is schematically illustrated in FIG. 1 (although not so illustrated because of the schematic nature of FIG. 1, the bore 4 has an irregular side wall, not a smooth side wall, as known to the art). It is contemplated, however, that the present invention has a more general utility, such as in any downhole apparatus having an inner tubular member and an outer tubular member in which the inner tubular member is slidably disposed but to which the inner tubular member is to be controllably lockable. Thus, the present invention provides a lock to selectably retain these tubular members against relative movement in at least one direction.

The dual packer assembly 2 schematically illustrated in FIG. 1 includes a bottom or lower packer section 6 of conventional design (such as the lower end of a Halliburton Services No. 2 NR packer assembly). Spaced above the lower packer section 6 is a top or upper packer section 8 which includes at least part of a conventional upper packer assembly (such as the top portion of a Halliburton Services No. 2 NR packer assembly), but which also incorporates the novel and improved lock of the present invention.

Shown mounted within a slotted sleeve 9 extending between the packer sections 6, 8 is a caliper tool 10 which is not part of the present invention. The caliper tool 10, however, exemplifies a device whose proper operation requires that the top packer section 8 not be displaced when the fracturing pressure, applied to the volume of the well bore 4 which is between the packer sections and in which the caliper tool 10 is disposed, exerts a force that exceeds any downwardly acting weight of the pipe on which the packer assembly 2 and the tool 10 are lowered into the well and the force of any hydrostatic head acting downwardly on the upper packer section 8. This illustrates the need for the lock of the present invention by which the upper packer section 8 can be effectively locked to the lower packer section 6, which is anchored by an anchor pipe 12 into the bottom or the side of the hole 4, to prevent upward movement of the packer of the section 8. The preferred embodiment of this lock is illustrated within the downhole apparatus shown in FIGS. 2A–2F.

The downhole apparatus illustrated in FIG. 2A–2F in conjunction with the lock of the present invnetion is an example of the upper packer section 8. This apparatus broadly includes an inner tubular member 14 and an outer tubular member 16, both of which include a plurality of components. The inner member 14 is slidable relative to the outer member 16, but these two members can be locked together by a lock 18 of the present invention.

Figure 2A:
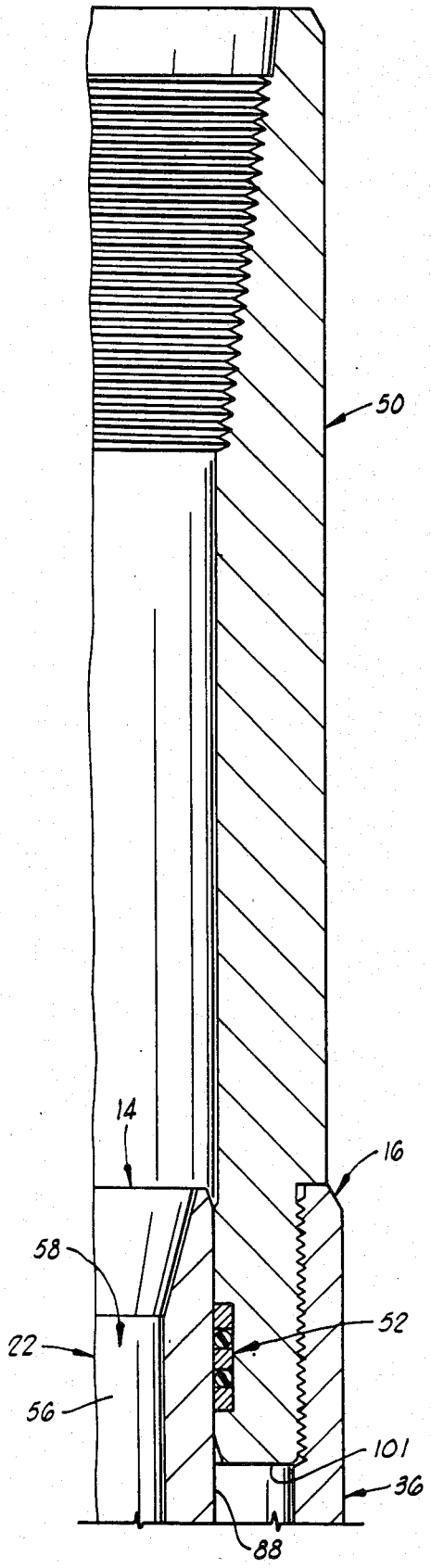
FIGS. 2A–2F form a partial sectional view of an upper packer section which can be used in the example illustrated in FIG. 1 and which includes the preferred embodiment of the lock of the present invention.
Figure 2B:
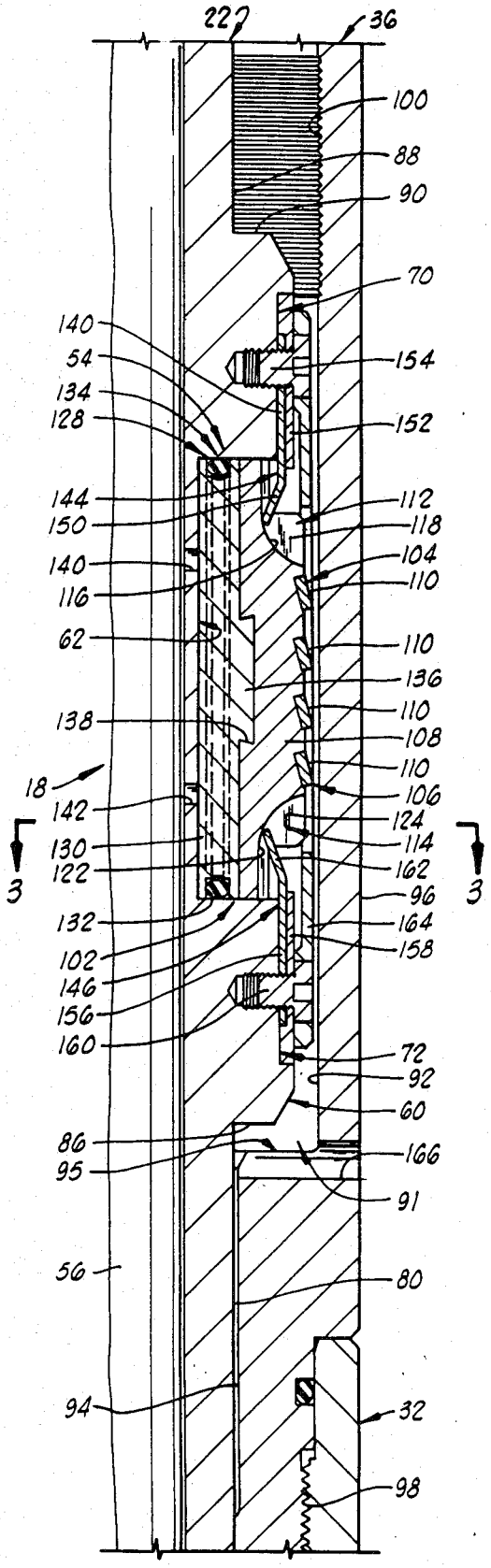
Figure 2C:
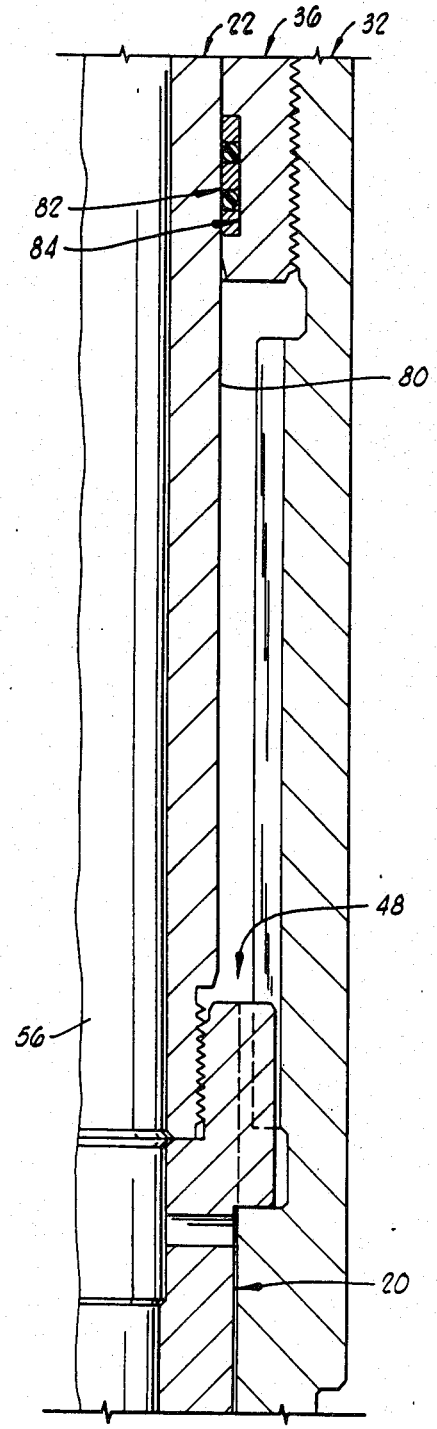

The inner tubular member 14 of the upper packer section 8 is characterized in the preferred embodiment as a mandrel assembly including a packer mandrel 20 (FIGS. 2C–2F) and a locking mandrel 22 (FIGS. 2A–2C). The packer mandrel 20 is a cylindrical tube of conventional design having a lower externally threaded end for engaging a lower adapter 24 of a conventional type used for connecting (through the caliper tool 10 in the FIG. 1 configuration) to the lower packer section 6 anchored on the bottom or in the side wall of the well bore 4 by the anchor pipe 12. The packer mandrel 20 has an internally threaded throat at its other end for threadedly coupling with an externally threaded end of the locking mandrel 22, which locking mandrel 22 forms part of the lock 18 and will be more particularly described hereinbelow.

Figure 2D:
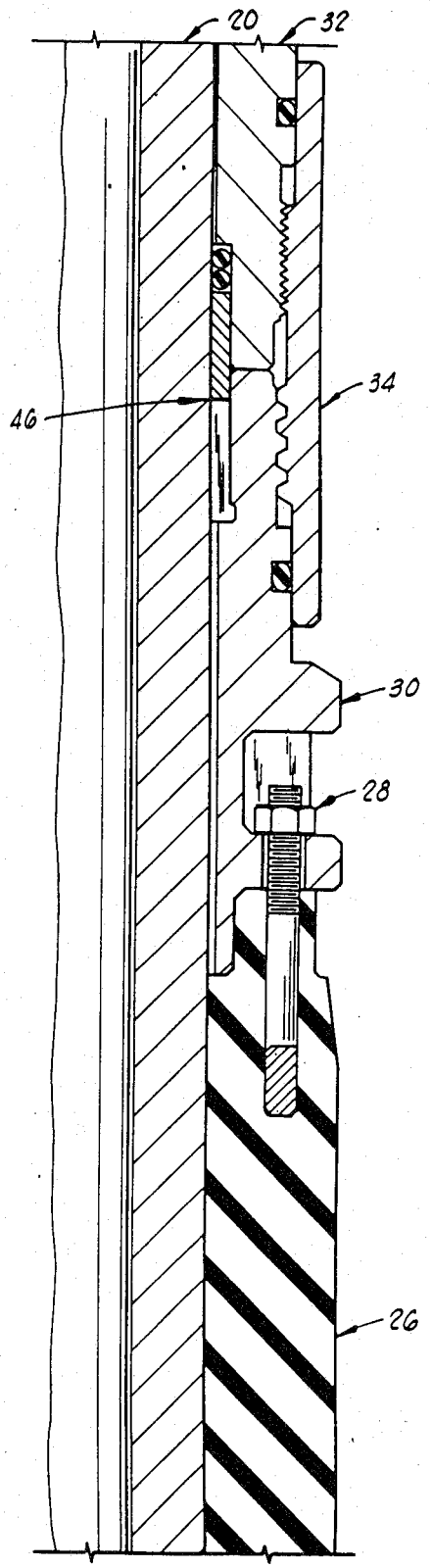

The outer tubular member 16 is characterized in the preferred embodiment as an upper packer carrying assembly having a packer 26 (FIGS. 2D–2E) connected (such as by a bolting fastening means including the nut and bolt combination 28 shown in FIG. 2D) to a packer carrier sleeve. The packer carrier sleeve includes a packer retaining collar 30, to which the packer 26 is fastened, and a connecting sleeve 32, to which the retaining collar 30 is connected by a quick change coupling 34 (FIGS. 2B–2D). The packer carrier sleeve of the outer tubular member 16 also includes a locking sleeve 36 (FIG. 2A–2C) which is threadedly connected to the connecting sleeve 32 and which forms another part of the lock 18 to be more particularly described hereinbelow.

Figure 2E:
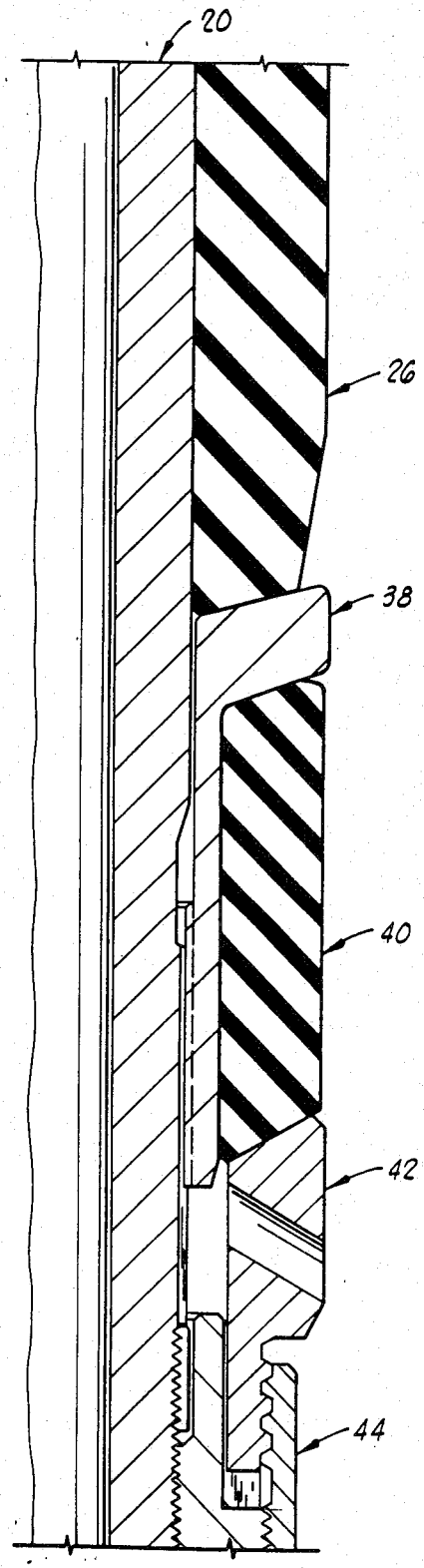
Figure 2F:
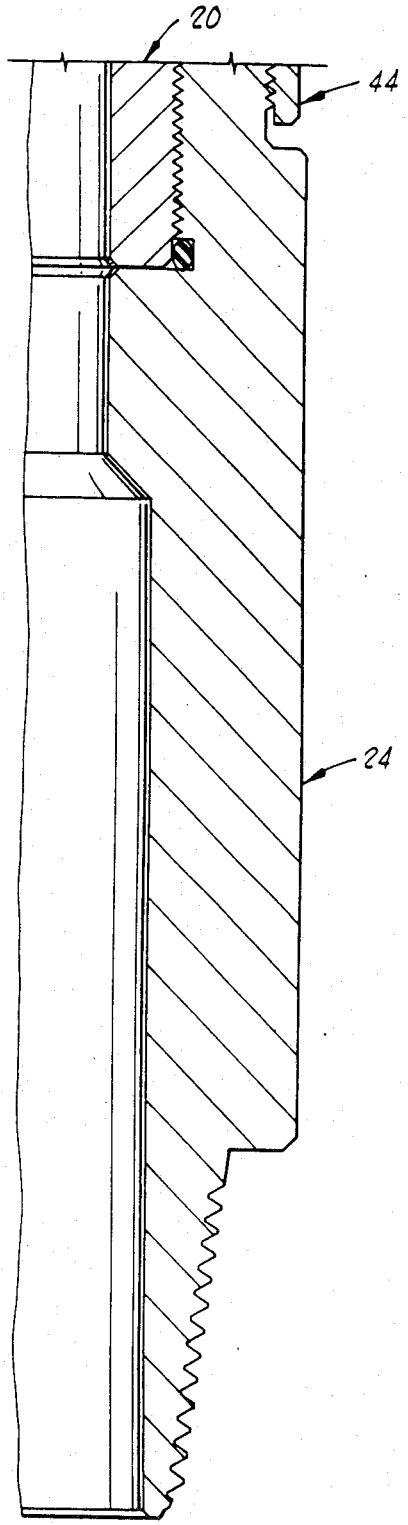

The packer 26 of the preferred embodiment is made of a composition (e.g., an elastomer) of a type as known to the art. It has an annular shape defining a hollow interior in which the packer mandrel 20 is slidably received. Providing lower support to the packer 26 are a packer support 38 (shown in FIG. 2E as being splined with the packer mandrel 20), a rubber packer shoe 40, a packer shoe support 42 and a coupling collar 44 threadedly interconnecting the shoe support 42 with the lower adapter 24 (FIGS. 2E–2F). These elements are of conventional designs known to the art and thus will not be further described.

The packer retaining collar 30, the connecting sleeve 32, and the quick change coupling 34 are also of conventional designs and will not be particularly described because these designs are known to the art. It will be noted, however, that the coupling between the packer retaining collar 30 and the connecting sleeve 32 includes a known type of seal 46 retained in between the packer retaining collar 30 and the connecting sleeve 32 and adjacent the packer mandrel 20 as shown in FIG. 2D. Additionally, the connecting sleeve 32 is shown as having a splined interconnecting relationship with the packer mandrel 20 as identified by the reference numeral 48 in FIG. 2C.

The outer tubular member 16 connects at its upper end to an upper adapter 50 (FIG. 2A) having a conventional design for connecting to the tubing or pipe string (not shown) on which the dual packer assembly 2, and the caliper tool 10 in the FIG. 1 example, are run into the open well bore 4. The upper adapter 50 carries a seal 52 for providing a sliding fluid seal between the upper adapter 50 and the locking mandrel 22.

The lock 18 includes not only the aforementioned locking mandrel 22 and the locking sleeve 36, but also a latching mechanism 54. Each of these elements will be more particularly described with primary reference to FIGS. 2A–2C, 3 and 4.

The locking mandrel 22 is a means for connecting part of the lock 18 with the packer mandrel 20 inside the portion of the upper packer section 8 defining the outer tubular member 16. The locking mandrel 22 is an elongated member having a cylindrical inner surface 56 defining a longitudinal channel 58 extending throughout the length of the locking mandrel 22. The channel 58 of the preferred embodiment is disposed axially through the mandrel 22.

Figure 3:
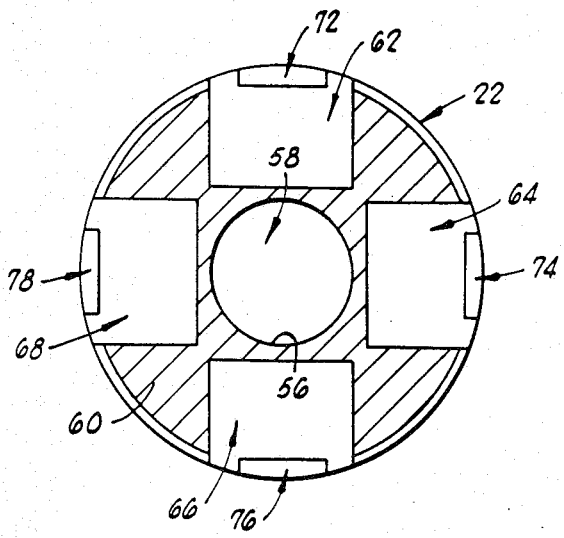
FIG. 3 is a sectional end view of a locking mandrel of the lock of the preferred embodiment as taken along line 3—3 shown in FIG. 2B, but without the other structures shown in FIG. 2B.
Figure 4:
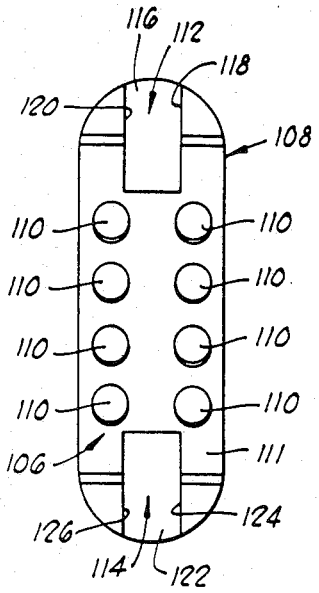
FIG. 4 is a plan view of a portion of a latch member of the lock of the preferred embodiment.

The mandrel 22 also has a cylindrical protuberant portion 60 extending radially outwardly from the main body of the mandrel 22. Milled or otherwise defined in the protuberant portion 60 are four cavities 62, 64, 66, 68 (FIGS. 2B and 3) which extend through the outer surface of the protuberant portion 60 and into the protuberant portion 60 transversely to the length of the mandrel 22. In the preferred embodiment these cavities extend radially with respective parallel side walls or surfaces extending perpendicularly from a respective bottom wall or surface. Associated with each of the four cavities are two slots extending longitudinally from opposite ends of the respective cavity. The two slots associated with the cavity 62 are identified in FIG. 2B by the reference numerals 70, 72. For the cavities 64, 66, 68, slots 74, 76, 78, respectively, corresponding to the slot 72 for the cavity 62, are shown in FIG. 3. The cavities 62, 64, 66, 68 are disposed in two pairs of diametrically opposed cavities whereby one pair includes the cavities 62, 66 and the other pair includes the cavities 64, 68. These cavities and slots open towards or face the locking sleeve 36.

The mandrel 22 also includes a cylindrical outer surface 80 defining a lower sealing surface engaged by a seal 82 (FIG. 2C) retained in a recess 84 of the locking sleeve 36. The diameter of the surface 80 is less than the outermost diameter of the protuberant portion 60 so that a radially extending annular shoulder 86 is defined therebetween.

The mandrel 22 has another cylindrical outer surface 88. The outer surface 88 extends longitudinally from the end of the protuberant portion 60 opposite the end thereof from which the surface 80 extends. The surface 88 has the same diameter as the surface 80; therefore, there is also a radially extending annular shoulder defined between the surface 88 and the outermost portion of the protuberant portion 60, which annular shoulder is identified in FIG. 2B by the reference numeral 90. The outer surface 88 defines an upper sealing surface engaged by the seal 52 carried by the upper adapter 50. The seal 52 and the seal 82 have the same size so that a hydraulically balanced seal is created between the locking mandrel 22 and the locking sleeve 36 on opposite sides of the protuberant portion 60.

The protuberant portion 60 can travel longitudinally or axially within a volume 91 defined between facing surfaces of the locking mandrel 22 and an inner surface 92 of the locking sleeve 36. This volume is also between the longitudinally spaced, circumferential seals 52, 82. This volume is defined in part by the inner surface 92 of the locking sleeve 36 being offset radially outwardly from an inner surface 94 of the locking sleeve 36. This offset is established across a radial annular shoulder 95 which faces the shoulder 86 of the locking mandrel 22. The locking sleeve 36 has a cylindrical outer surface 96 and a threaded outer cylindrical surface 98 radially inwardly offset from the surface 96 for engaging an internal thread of the connecting sleeve 32.

Defined along the inner surface 92 is a locking sleeve engagement surface 100 comprising in the preferred embodiment grooves or serrations or teeth defining engagement means for interlocking with cooperating elements of a latch member forming part of the latching mechanism 54. The locking sleeve engagement surface 100 is not coextensive with the length of the surface 92 so that the latching mechanism 54 is longitudinally movable between a longitudinally located unlatched or disengagement position, located in the preferred embodiment relatively closer to the shoulder 95 than to the opposite end of the volume adjacent a radial annular surface 101 of the upper adapter 50, and a longitudinally located latchable or engagement position, wherein at least part of the latching mechanism overlies at least a portion of the locking sleeve engagement surface 100.

The latching mechanism 54 of the preferred embodiment includes latch member means, slidably disposed in at least one of the cavities 62, 64, 66, 68, for engaging the packer carrying sleeve assembly (specifically, the locking sleeve engagement surface 100 in the preferred embodiment) when the latch member means is moved to the aforementioned longitudinal engagement position and then to a radially located latched or engagement position. The latching mechanism 54 also includes actuating pressure communicating means, disposed in the tubular member on which the latch member means is mounted, for communicating an actuating pressure to the latch member means so that the latch member means moves towards the other tubular member, and into the radial engagement position, in response to the actuating pressure. The latching mechanism 54 also includes biasing means, connected to the tubular member on which the latch member means is mounted, for exerting a biasing force against the latch member means in opposition to a force exerted on the latch member means by the actuating pressure so that the latch member means is biased away from the other tubular member and thus towards a radial disengagement position which is out of engagement with the locking sleeve engagement surface 100 even though the locking member means even partially overlies the engagement surface 100 and is thus at a longitudinal latchable or engageable position. Thus, this biasing force tends to move the latch member means deeper into its respective cavity. The latching mechanism 54 still further includes hydrostatic pressure communicating means, disposed in the tubular member on which the latch member means is not mounted for communicating a hydrostatic pressure to the latch member means so that a force exerted by the hydrostatic pressure is applied to the latch member means in opposition to a force exerted on the latch member means by the actuating pressure.

The latch member means of the preferred embodiment includes four latch members, each disposed in a respective one of the cavities 62, 64, 66, 68. Because each of these latch members is identical, only a latch member 102 principally shown in FIG. 2B will be described. The latch member 102 includes a gripping member or means 104 for defining a latch member engagement surface 106 (see also FIG. 4) facing the inner surface 92 of the locking sleeve 36. The gripping means 104 of the preferred embodiment is constructed of an oblong carrier block 108 and a plurality of gripping teeth 110 defined in the preferred embodiment by carbide inserts retained in the carrier block 108 at oblique angles thereto to give a tilted configuration to the carbide inserts which facilitates their ability to bite or grip into the locking sleeve engagement surface 100 of the locking sleeve 36. The teeth 110 are received along a rectangular planar surface 111 of the carrier block 108, and they define a plurality of protuberances extending from the surface of the carrier block 108. Milled or otherwise defined in opposite ones of the curved ends of the oblong block 108 are respective recesses 112, 114. The recess 112 has a curved lower surface 116. Parallel planar surfaces 118, 120 extend from opposite edges of the surface 116. The recess 114 has a curved lower surface 122 and parallel planar surfaces 124, 126 extending from opposite edges of the surface 122.

The latch member 102 also includes seal means 128, detachably connected to the carrier block 108, for providing a sliding seal between the latch member 108 and the inner side walls of the cavity 62 in which the latch member 102 is disposed. The seal means 128 includes a seal support member 130 having an oblong configuration similar to that of the carrier block 108 and similar to the shape of the cavity 62. A peripheral groove 132 is defined around the perimeter of the seal support member 130. The groove 132 receives a seal assembly 134 comprising an O-ring or other suitable fluid member and also comprising a seal back-up ring which reduces the friction of the movable seal and which reinforces the primary seal ring against high pressure differentials that may exist across the sealing structure.

The seal support member 130 is connected to the carrier block 108 by a suitable connector means whereby the two are releasably connected to enable the carrier block 108 to be released from the seal support member 130, such as when the latch member engagement surface defined by the gripping teeth 110 is worn out and is to be replaced with another such gripping means. In the preferred embodiment this connector means includes a dovetail tenon 136, protruding from a central portion of the seal support member 130, and a mortise 138, defined centrally along and transversely across a surface of the carrier block 108 for slidably receiving the dovetail tenon 136.

These components of the latch member 102 define a slidable body which is movable within the cavity 62. Corresponding components define a plurality of other latch members respectively disposed in the cavities 64, 66, 68 for simultaneous slidable movement with the latch member 102. These movements occur in response to an actuating pressure provided through the tubing or pipe string from the surface and into the channel 58 of the locking mandrel 22 for communication into the cavitites 62, 64, 66, 68 through respective ones of the plurality of actuating pressure communicating means contained in the preferred embodiment of the present invention. Because each of these communicating means is identical in the preferred embodiment, only the one associated with the cavity 62 will be particularly described hereinbelow.

In the preferred embodiment the actuating pressure communication means communicates a hydraulic pressure from the axial channel 58 into the cavities 62, 64, 66, 68 of the locking mandrel 22. This pressure exerts a force against the latch member 102 and the other similar latch members. This force, when sufficiently strong, moves the latch members radially outwardly so that at least portions of the engagement surfaces thereof interlock with at least a portion of the locking sleeve engagement surface 100 of the locking sleeve 36 when these portions are radially aligned. This radial alignment is achieved after the packers have been set as will be more particularly described hereinbelow.

To provide this communication to the cavity 62, the preferred embodiment actuating pressure communicating means associated with the cavity 62 includes two holes 140, 142 defined by respective transverse walls of the locking mandrel 22. These walls extend between the channel 58 and the transverse cavity 62. In the preferred embodiment these walls are specifically radially extending walls. The actuating pressure communicated through these holes can be derived from the fracturing fluid pumped down through the central channel extending through the entire upper packer section 8 for introduction into the open well bore volume encompassed between the spaced packers of the lower and upper packer sections 6, 8.

The biasing means of the preferred embodiment latch mechanism 54 includes two spring members for each of the latch members. Because the spring members are identical, only the two associated with the latch member 102 shown in FIG. 2B will be described. These spring members are identified by the reference numerals 144, 146. The spring member 144 has a support portion 148 and an engagement portion 150 extending at an obtuse angle from the support portion 148. The spring member 144 is made of a resilient material so that the engagement portion 150 can bend relative to the support portion 148, but with a resulting biasing force being created tending to return the engagement portion 150 to its rest position shown in FIG. 2B. This action provides a biasing force which acts in opposition to the direction of the hydraulic actuating pressure applied through the holes 140, 142 and thereby tends to move the latch member 102 deeper into the cavity 62. This acts as a return force when the actuating pressure is removed.

The support portion 148 is received in the slot 70, and the engagement portion 150 extends as a spring finger into the recess 112 of the latch member 102. The spring member 144 is secured in the slot 70 by suitable connecting means which achieves the aforementioned construction wherein the end of the spring member 144 defined by the engagement portion 150 overhangs the cavity 62 and engages the carrier block 108 within its recess 112 to exert a radially inwardly directed force on the block 108 and thus on the overall latch member 102. This connecting means comprises in the preferred embodiment a spring backup or support member 152 placed adjacent the support portion 148 of the spring member 144, and the connecting means also includes a screw or bolt 154 extending through holes defined in the support portion 148 and the spring support member 152 and into a radially extending threaded bore extending from the slot 70 into the protruberant portion 60 of the locking mandrel 22.

The spring member 146 is constructed and situated similarly to the spring member 144, except that it has a support portion 156 which is secured in the slot 72 by a spring support member 158 and a screw or bolt 160. This allows an engagement portion 162 of the spring member 146 to extend into the recess 114 of the latch member 102. Therefore, the spring member 146 extends in an opposite direction towards the spring member 144 and in a manner so that the engagement portion 162 overhangs the cavity 62 and engages the carrier block 108 to exert a radially inwardly directed force on the block 108.

The biasing means also includes a retaining ring 164 freely disposed between the screws or bolts 154, 160 and partially overlying the spring members 144, 146 and the carrier block 108. The ring 164 acts as a safety backup to prevent the spring members 144, 146 from becoming too outwardly extended.

The hydrostatic pressure communicating means of the latching mechanism 54 includes four radial passages defined through the locking sleeve 36 so that a pressure existing externally of the locking sleeve 36 is communicated internally thereof to exert a radially inwardly directed force on the latch member 102 and, in particular, on the carrier block 108 thereof. These four passages are equally spaced around the circumference of the locking sleeve 36 so that only one, identified as a hole 166, is shown in FIG. 2B. In the preferred embodiment each of these holes has a one-half inch diameter; however, any suitable size hole can be used. The hole 166, and its three counterparts, extend radially through the locking sleeve 36 along the shoulder 95 defined between the offset inner surfaces 92, 94. This provides communicaton passages for allowing the hydrostatic pressure existing outside the upper packer section 8 and above the packer 26 to be communicated into the volume 91 within the locking sleeve 36 between the seals 52, 82. These holes also allow the hydraulic chamber or volume 91 to fill with fluid as the dual packer assembly 2 is run in the hole, thereby balancing the internal and external pressures across the latch members during this time.

To use the present invention, the packer assembly 2 is attached to a tubing or pipe string (not shown) and run into the well bore 4 in a manner as known to the art. When the dual packer assembly 2 is at the appropriate location, the packer 26 and the packer of the lower packer section 6 are set, also in a manner as known to the art. In running this structure into the well bore 4, the inner and outer tubular members of the upper packer section 8 are situated as shown in FIGS. 2A–2F; however, when the packers are set, relative movement between the inner and outer tubular members occurs so that the latch member 102, and the other three latch members disposed in the cavities 64, 66, 68, have at least portions of their latch member engagement surfaces radially aligned with at least a portion of the locking sleeve engagement surface 100. At this time, but prior to a sufficient actuating pressure being applied down through the tubing or pipe string and into the channel 58 of the locking mandrel 22, the spring members of the biasing means are holding the respective latch members in their radial unlatched positions, which are relatively radially inward positions, such as is illustrated by the position of the latch member 102 in FIG. 2B. These latch members are also held in these unlatched radial positions by the hydrostatic pressure existing in the annulus between the locking sleeve 36 and the surface of the well bore 4. This hydrostatic pressure is exerted on the latch members by being communicated thereto through the radial passages of the hydrostatic pressure communicating means (e.g., the hole 166). Locating the lock 18 above the top packer 26 isolates and limits the outside or external force acting radially inwardly on the latch members to the hydrostatic pressure.

When the hydraulic lock of the preferred embodiment of the present invention is to be actuated, whereby the latch members are moved into their engagement positions with the gripping teeth of the latch members interlocking with the locking sleeve engagement surface 100, a fluid is flowed down the tubing or pipe string into the channel 58 and pressurized until a sufficiently strong radially outwardly directed force is exerted through the actuating pressure communicating means (e.g., the holes 140, 142) on each of the latch members. A sufficient force is one which exceeds the forces exerted by the spring members and the hydrostatic pressure. The application of this radially outwardly directed force simultaneously moves each of the latch members radially outwardly to lock the inner tubular member 14 to the outer tubular member 16. This in effect locks the packer 26 to the lower packer section 6 because the inner tubular member 14 is connected to the lower packer section 6 through the lower adapter 24. As long as the tubing pressure exceeds the hydrostatic pressure and the biasing force of the spring members, the latch members lock into the outer housing of the upper packer section 8, thereby preventing upward movement of the top packer 26. Once the fracturing or other actuating pressure is removed, the latch members are returned to their original radially disengaged positions by the hydrostatic pressure and the retracting spring members of the biasing means.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A lock for a downhole apparatus having an inner tubular member and an outer tubular member in which the inner tubular member is slidably disposed, said lock comprising:

a latch member mounted on one of the inner and outer tubular members;

actuating pressure communicating means, disposed in the one of the inner and outer tubular members on which said latch member is mounted, for communicating an actuating pressure to said latch member so that said latch member moves towards the other of the inner and outer tubular members in response to the actuating pressure;

latch member engagement means, mounted on the other of the inner and outer tubular members, for interlocking with said latch member when said latch member is moved in response to the actuating pressure; and hydrostatic pressure communicating means, disposed in the other of the inner and outer tubular members, for communicating a hydrostatic pressure to said latch member so that a force exerted by the hydrostatic pressure is applied to said latch member in opposition to a force exerted on said latch member by the actuating pressure.

2. A lock as defined in claim 1, further comprising biasing means, connected to the one of the inner and outer tubular members on which said latch member is mounted, for biasing said latch member away from the other of the inner and outer tubular members.

3. A lock as defined in claim 1, further comprising biasing means, connected to the one of the inner and outer tubular members on which said latch member is mounted, for exerting a biasing forcing against said latch member in opposition to the force exerted on said latch member by the actuating pressure.

4. A lock a defined in claim 1, wherein said latch member includes:

a slidable body disposed in a cavity defined in the one of the inner and outer tubular members on which said latch member is mounted; and a plurality of gripping teeth protruding from said slidable body.

5. A lock as defined in claim 4, wherein said slidable body includes:

carrier means for carrying said gripping teeth; and seal means, detachably connected to said carrier means, for providing a sliding seal between said latch member and the cavity of the one of the inner and outer tubular members on which said latch member is mounted.

6. A lock as defined in claim 1, wherein said latch member includes a block slidably disposed in a radial cavity of the one of the inner and outer tubular members so that said block is constrained to radial travel in response to the actuating pressure.

7. A lock as defined in claim 1, further comprising:

biasing means, connected to the one of the inner and outer tubular members on which said latch member is mounted, for exerting a biasing force against said latch member in opposition to the force exerted on said latch member by the actuating pressure.

8. A lock for a packer assembly having a packer mandrel and a packer carrier sleeve, said lock comprising:

locking mandrel means for connecting with the packer mandrel inside the packer carrier sleeve, said locking mandrel means having a longitudinal channel and a transverse cavity defined therein;

latch member means, slidably disposed in said transverse cavity, for engaging the packer carrier sleeve when said latch member means is moved to an engagement position between said locking mandrel means and the packer carrier sleeve; and actuating pressure communicating means, disposed in said locking mandrel means, for communicating an actuating pressure from said longitudinal channel to said transverse cavity to move said latch member means to said engagement position.

9. A lock as defined in claim 8, wherein said latch member means includes:

a seal support member;

a seal disposed around the perimeter of said seal support member in slidable sealing engagement with said transverse cavity; and a gripper member, connected to said seal support member, having a plurality of protuberances extending therefrom.

10. A lock as defined in claim 9, further comprising a spring member connected to said locking mandrel means in engagement with said gripper member.

11. A lock as defined in claim 10, wherein said actuating pressure communicating means includes a hole defined by a transverse wall of said locking mandrel means extending between said longitudinal channel and said transverse cavity so that the actuating pressure communicated therethrough exerts a force on said seal support member.

12. A lock as defined in claim 8, wherein:

said locking mandrel means includes a plurality of other transverse cavities disposed circumferentially around said locking mandrel means in pairs of diametrically opposed cavities; and said lock further comprises:

a plurality of other latch member means, each slidably disposed in a respective one of said other transverse cavities, for engaging the packer carrier sleeve when each is moved to a respective engagement position between said locking mandrel means and the packer carrier sleeve; and a plurality of other actuating pressure communicating means, disposed in said locking mandrel means, for simultaneously communicating the actuating pressure from said longitudinal channel to all said other transverse cavities to move said other latch member means to their respective engagement positions.

13. A hydraulic lock for holding down an upper packer mounted on a packer mandrel connected to a lower packer, said lock comprising:

a locking sleeve connected to the upper packer, said locking sleeve having an inner surface along which is defined a locking sleeve engagement surface;

a locking mandrel connected to the packer mandrel, said locking mandrel having an outer surface, facing said inner surface of said locking sleeve, and an inner surface, defining an axial channel through said locking mandrel, said outer surface having a radial cavity defined therethrough extending within said locking mandrel towards said axial channel;

a latch member slidably disposed in said cavity, said latch member having a latch member engagement surface facing said inner surface of said locking sleeve; and hydraulic pressure communicating means, disposed in said locking mandrel, for communicating a hydraulic pressure from said axial channel into said cavity and against the said latch member, whereby said latch member is thereby movable, so that at least a portion of said latch member engagement surface interlocks with at least a portion of said locking sleeve engagement surface when said portions are radially aligned and said hydraulic pressure is applied.

14. A lock as defined claim 13, further comprising:

two longitudinally spaced seals disposed between said locking sleeve and said locking mandrel; and hydrostatic pressure communicating means, disposed in said locking sleeve, for communicating a hydrostatic pressure from outside said locking sleeve into a volume between said locking sleeve and said locking mandrel and between said two seals, said volume having said latch member received therein.

15. A lock as defined in claim 14, further comprising resilient biasing means, connected to said locking mandrel, for exerting on said latch member a biasing force tending to move said latch member deeper into said cavity.

16. A lock as defined in claim 13, wherein said latch member includes:

seal means for providing a slidable fluid seal between said latch member and the portion of said locking mandrel defining said cavity;

gripping means for defining said latch member engagement surface; and connector means for releasably connecting said gripping means to said seal means so that said gripping means can be released from said seal means when said latch member engagement surface is worn out and to be replaced with another girpping means.

17. A lock as defined in claim 16, wherein said connector means includes:

a dovetail tenon protruding from said seal means; and a mortise defined in said gripping means for slidably receiving said dovetail tenon.

18. A lock as defined in claim 16, wherein:

said gripping means includes an oblong block having a first recess defined in one end thereof and having a second recess defined in another end thereof; and said lock further comprises:

a first spring finger;

means for connecting said first spring finger to said locking mandrel so that an end of said first spring finger overhangs said cavity and engages said block in said first recess to exert a radially inwardly directed force on said block;

a second spring finger; and means for connecting said second spring finger to said locking mandrel so that an end of said second spring finger overhangs said cavity and engages said block in said second recess to exert a radially inwardly directly force on said block.

19. A lock as defined in claim 18, wherein:

said hydraulic pressure communicating means includes a radial wall of said locking mandrel defining a hole extending therethrough between said channel and said cavity so that a hydraulic pressure within said channel exerts a radially outwardly directed force to said seal means of said latch member; and said lock further comprises a radial passage defined through said locking sleeve so that a pressure existing externally of said locking sleeve exerts a radially inwardly directed force on said block.

* * * * *